US005750323A

United States Patent [19]

Scaringe et al.

[11] Patent Number: 5,750,323

[45] Date of Patent: May 12, 1998

[54] SOLID PARTICLE DISPERSIONS FOR IMAGING ELEMENTS

[75] Inventors: Raymond Peter Scaringe; David Darrell Miller, both of Rochester; Mary Christine Brick; Leslie Shuttleworth, both of Webster; Margaret Jones Helber; Steven Evans, both of Rochester, all of N.Y.

[73] Assignee: Eastman Kodak Company, Rochester, N.Y.

[21] Appl. No.: 698,378

[22] Filed: Aug. 15, 1996

Related U.S. Application Data

[60] Provisional application No. 60/003,065, Aug. 31, 1995.

[51] Int. Cl.[6] ..... G03C 1/06; G03C 1/10; G03C 1/38; G03C 7/388

[52] U.S. Cl. ..... 430/512; 430/200; 430/201; 430/449; 430/517; 430/519; 430/520; 430/521; 430/522; 430/493; 430/546; 430/559; 430/566; 430/570; 430/607; 430/631; 106/401; 106/494; 252/363.5; 503/227

[58] Field of Search ..... 430/201, 546, 430/631, 493, 200, 449, 517, 519, 520, 521, 522, 559, 566, 570, 607; 106/401, 494; 252/363.5; 503/227

[56] References Cited

U.S. PATENT DOCUMENTS

| | | | |
|---|---|---|---|
| 2,353,262 | 7/1944 | Peterson et al. | 430/546 |
| 2,870,012 | 1/1959 | Godowsky et al. | 96/97 |
| 4,006,025 | 2/1977 | Swank et al. | 96/129 |
| 4,146,399 | 3/1979 | Trunley et al. | 96/82 |
| 4,294,916 | 10/1981 | Postle et al. | 430/522 |
| 4,294,917 | 10/1981 | Postle et al. | 430/522 |
| 4,900,653 | 2/1990 | Factor et al. | 430/522 |
| 4,927,744 | 5/1990 | Hanzel et al. | 430/566 |
| 4,940,654 | 7/1990 | Diehl et al. | 430/522 |
| 4,948,717 | 8/1990 | Diehl et al. | 430/510 |
| 4,950,586 | 8/1990 | Diehl et al. | 430/507 |
| 4,957,857 | 9/1990 | Chari | 430/546 |
| 4,970,139 | 11/1990 | Bagchi | 430/499 |
| 4,988,611 | 1/1991 | Anderson et al. | 430/494 |
| 4,990,431 | 2/1991 | Bagchi et al. | 430/372 |
| 5,008,179 | 4/1991 | Chari et al. | 430/546 |
| 5,013,640 | 5/1991 | Bagchi et al. | 430/546 |
| 5,015,564 | 5/1991 | Chari | 430/546 |
| 5,071,738 | 12/1991 | Mizukura et al. | 430/546 |
| 5,089,380 | 2/1992 | Bagchi | 430/499 |
| 5,091,296 | 2/1992 | Bagchi et al. | 430/546 |
| 5,135,844 | 8/1992 | Bagchi et al. | 430/546 |
| 5,151,346 | 9/1992 | Terai et al. | 430/546 |
| 5,158,863 | 10/1992 | Bagchi et al. | 430/449 |
| 5,171,650 | 12/1992 | Ellis et al. | 430/201 |
| 5,232,817 | 8/1993 | Kawakami et al. | 430/201 |
| 5,240,821 | 8/1993 | Texter et al. | 430/405 |
| 5,256,527 | 10/1993 | Chari et al. | 430/449 |
| 5,278,023 | 1/1994 | Bills et al. | 430/201 |
| 5,278,037 | 1/1994 | Karino | 430/513 |
| 5,279,654 | 1/1994 | Keirs et al. | 106/20 R |
| 5,279,931 | 1/1994 | Bagchi et al. | 430/449 |
| 5,283,165 | 2/1994 | Diehl et al. | 430/522 |
| 5,300,394 | 4/1994 | Miller et al. | 430/137 |
| 5,360,695 | 11/1994 | Texter | 430/203 |
| 5,360,702 | 11/1994 | Zengerle et al. | 430/505 |
| 5,468,598 | 11/1995 | Miller et al. | 430/372 |
| 5,478,705 | 12/1995 | Czekai et al. | 430/449 |
| 5,500,331 | 3/1996 | Czekai et al. | 430/449 |

FOREIGN PATENT DOCUMENTS

| | | |
|---|---|---|
| 1131399 | 10/1968 | United Kingdom . |
| 1570362 | 7/1980 | United Kingdom . |

*Primary Examiner*—Richard L. Schilling .
*Attorney, Agent, or Firm*—Andrew J. Anderson

[57] ABSTRACT

Solid particle dispersions of compounds useful in imaging elements can be made with substantially improved stability to particle growth by dispersing the compound of interest in the presence of a relatively small amount of a second compound that is structurally similar to the compound of interest. This second compound is combined with the compound of interest prior to dispersing the compound of interest, i.e., prior to milling in the case of milled dispersions, and prior to precipitation in the case of pH or solvent precipitated dispersions. While being distinct, the second compound has a similar chemical structure to the main compound. More specifically, the second compound and first compound each comprise an identical structural section thereof which makes up at least 75% of the total molecular weight of the first compound, and the second compound has at least one substituent bonded to the identical structural section which has a molecular weight higher than the corresponding substituent of the first compound. In preferred embodiments of the invention, the compound useful in imaging elements is a compound useful in photographic or thermal transfer printing elements, and the resulting stabilized dispersion is used in preparing a photographic or thermal transfer printing element.

30 Claims, No Drawings

SOLID PARTICLE DISPERSIONS FOR IMAGING ELEMENTS

CROSS REFERENCE TO RELATED APPLICATION

Reference is made to priority claimed from U.S. Provisional application Ser. No. US 60/003,065, filed 31 Aug. 1995, entitled IMPROVED PARTICLE DISPERSIONS FOR IMAGING ELEMENTS.

This invention relates to imaging technology such as photographic and thermal printing technologies, and in particular, to a method for stabilizing aqueous solid particle dispersions of compounds useful in imaging elements.

BACKGROUND OF THE INVENTION

Substantially water-insoluble compounds useful in imaging are commonly incorporated into imaging elements in the form of aqueous coated layers of such imaging materials as dispersions or emulsions. In many cases, the compound useful in imaging is dissolved in one or more organic solvents, and the resulting oily liquid is then dispersed into an aqueous solution containing, optionally, dispersing aids such as surfactants and/or hydrophilic colloids such as gelatin. Dispersal of the oily liquid into the aqueous medium is accomplished using high shearing rates or high turbulence in devices such as colloid mills, ultrasonicators, or homogenizers.

In the art of dispersion making, the use of organic solvents has traditionally been considered necessary to achieve small particle sizes, to achieve stable dispersions, and to achieve the desired reactivity of the compound useful in imaging. Some compounds that might be useful in imaging cannot be dispersed in the above manner, however, because of their poor solubility in most organic solvents. In other cases, the compound of interest may have sufficient solubility in organic solvents, but it may be desirable to eliminate the use of the organic solvent to reduce the attendant adverse effects, for example, to reduce coated layer thickness, to reduce undesirable interactions of the organic solvent with other materials in the imaging element, to reduce risk of fire or operator exposure in manufacturing, or to improve the sharpness of the resulting image.

The above problems and other disadvantages associated with oil-in-water type dispersions can be overcome by the use of solid particle dispersions of the compound useful in imaging. Techniques for making solid particle dispersions, however, are very different from the techniques used to make dispersions of oily liquids.

Solid particle dispersions of compounds useful in imaging may be conventionally made by mixing a crystalline solid of interest with an aqueous solution that may contain one or more stabilizers or grinding aids. Particle size reduction is accomplished by subjecting the solid crystals in the slurry to repeated collisions with beads of hard milling media, such as sand, spheres of silica, stainless steel, silicon carbide, glass, zirconium, zirconium oxide, alumina, titanium, etc., which fracture the crystals. Polymeric milling media, such as polystyrene beads, may also be used as described in copending, commonly assigned U.S. Ser. No. 08/248,925 of Czekai et al., filed May 25, 1994. The conventional milling media bead sizes typically range from 0.25 to 3.0 mm in diameter. Smaller milling media having a mean particle size less than 100 microns may also be used as described in copending, commonly assigned U.S. Ser. No. 08/248,774 of Czekai et al., filed May 25, 1994. Ball mills, media mills, attritor mills, jet mills, vibratory mills, etc. are frequently used to accomplish particle size reduction. These methods are described, e.g., in U.S. Pat. Nos. 4,006,025, 4,294,916, 4,294,917, 4,940,654, 4,950,586 and 4,927,744, and UK 1,570,362.

Solid particle dispersions of compounds useful in imaging can also be made conventionally by precipitation techniques, e.g., where a compound of interest is dissolved in an aqueous solution at high pH, together with appropriate surfactants and polymers, and subsequently precipitated by lowering the pH of the solution. These methods are described, e.g., in GB 1,131,399, and U.S. Pat. Nos. 5,279,931, 5,158,863, 5,135,844, 5,091,296, 5,089,380, 5,013,640, 4,990,431, 10 4,970,139, 5,256,527, 5,015,564, 5,008,179, and 4,957,857. Another known method of precipitation involves dissolving the compound useful in imaging in a water-miscible organic solvent and subsequently mixing this solution with water containing appropriate stabilizers to cause precipitation of the compound and formation of the solid particle dispersion. These methods are described, e.g., in U.S. Pat. No. 2,870,012.

Unfortunately, solid particle dispersions made by the grinding or precipitation techniques described above are frequently subject to unwanted particle growth, either in the solid particle dispersion itself, or when the dispersion is mixed with other materials useful in imaging prior to coating onto a support. The stabilization of solid particle dispersions is much more difficult than the stabilization of conventional liquid droplet dispersions, since traditional stabilizers such as anionic or nonionic alkyl or aryl surfactants tend to adsorb much more readily to liquid surfaces than to solid surfaces. Compounds with even exceptionally low water-solubility have been found to be subject to undesired particle growth. In particularly bad cases, particle growth may result in the formation of long, needle-like crystals of the compound of interest. Such particle growth is undesirable, e.g., as it reduces the covering power of the compound of interest, such as a filter dye, thermal transfer dye, UV absorbing dye, antihalation dye, oxidized developer scavenger, or other compound useful in photography and thermal printing in the coated layers of a photographic or thermal printing element. The presence of needle-like crystals is also undesirable, as they result in filter plugging and poor manufacturability. Solid particle dispersions of photographic filter dyes have been found to be particularly susceptible to needle growth when mixed, prior to coating, with conventional dispersions containing organic solvents.

Unwanted particle growth in solid particle dispersions of compounds useful in imaging can be improved by using fluorinated surfactants as grinding aids as described in U.S. Pat. No. 5,300,394. Fluorocarbon surfactants are expensive, however, and in some instances can reduce surface tensions of coated layers to below levels that are desirable for coating. Certain hydrophobic, water-soluble polymers have also been disclosed as grinding aids for solid particle dispersions of filter dyes and thermal transfer dyes in copending, commonly assigned U.S. Ser. No. 08/228,839 to Miller, Nair, and Brick filed Apr. 18, 1994. Anionic hydrophilic polymers have been disclosed to improve dispersion stability of solid dyes in U.S. Pat. No. 5,278,037. Water soluble polymers such as polyvinylpyrrolidone have been added to solid particle dispersions of sensitizing dyes to reduce particle or crystal growth, as described in U.S. Pat. No. 4,006,025. Use of such polymers as described in such patents and patent applications, however, can increase the viscosity of coating melts and may have undesirable interactions with other materials in photographic or thermal printing elements.

Flocculation in pigmentary dispersions of phthalocyanine derivatives used for printing inks has been controlled by milling the pigment in the presence of a second phthalocyanine derivative containing a nitrogen-bearing substituent, as described in U.S. Pat. No. 5,279,654. Such patent does not suggest, however, using such derivatives to control undesired particle growth of individual solid particles in a solid particle dispersion of a compound useful in imaging elements.

PROBLEMS TO BE SOLVED

It would be desirable to provide increased control over undesirable particle growth of solid particles in a solid particle dispersion of a compound useful in imaging elements. Accordingly, it is an object of the present invention to provide a method for making solid particle dispersions of compounds useful in imaging elements that are stable to particle growth.

SUMMARY OF THE INVENTION

We have found that solid particle dispersions of compounds useful in imaging elements can be made with substantially improved stability to particle growth by dispersing the compound of interest in the presence of a minor amount of a second compound that is structurally similar to the compound of interest. This second compound is combined with the compound of interest prior to dispersing the compound of interest, i.e., prior to milling in the case of milled dispersions, and prior to precipitation in the case of pH or solvent precipitated dispersions. While being distinct, the second compound has a similar chemical structure to the main compound. More specifically, the second compound and first compound each comprise an identical structural section thereof which makes up at least 75% of the total molecular weight of the main compound, while the structurally similar second compound has at least one substituent bonded to the identical portion common with the first compound which has a molecular weight higher than the corresponding substituent of the first compound.

One aspect of this invention comprises a process for preparing a solid particle aqueous dispersion of a first compound useful in imaging elements, where dispersed solid particles of said first compound are subject to undesirable particle growth when said first compound is dispersed in the absence of any other distinct compound structurally similar to said first compound, comprising: (a) adding a structurally similar distinct additive to said first compound, such additive and first compound each comprising an identical structural section thereof which makes up at least 75% of the total molecular weight of the first compound, and the additive having at least one substituent bonded to the identical structural section which has a molecular weight higher than the corresponding substituent of the first compound, and (b) dispersing said first compound and additive together in an aqueous medium.

Another aspect of this invention comprises a stable solid particle dispersion comprising solid particles of a first compound useful in imaging elements and a structurally similar distinct additive as defined above co-dispersed in an aqueous medium.

In preferred embodiments of the invention, the compound useful in imaging elements is a compound useful in photographic or thermal transfer printing elements, and the resulting stabilized dispersion is used in preparing a photographic or thermal transfer printing element.

ADVANTAGEOUS EFFECT OF THE INVENTION

With our invention, aqueous solid particle dispersions of compounds useful in imaging which are subject to undesirable particle growth can be made more quickly (i.e., with faster rates of particle size reduction), or with smaller particle size, and with vastly improved stability to particle and needle growth relative to prior art solid particle dispersions made in the absence of the additive.

DETAILED DESCRIPTION

It has been found that mixing a compound useful in imaging elements, such as a compound useful in photographic or thermal printing imaging elements, with a distinct, but structurally similar additive prior to dispersal in an aqueous medium results in solid particle dispersions that are substantially more stable to particle growth than similar dispersions made without such additives. The structurally similar additives are characterized as being structurally distinct from the compound of interest, while containing an identical portion comprising at least 75%, preferably more than 90%, and most preferably more than 99% of the chemical structure on a molecular weight basis of the compound of interest. By having at least 75% of the same chemical structure, we mean that no more than 25% of the chemical structure of the main compound, on a molecular weight basis, is replaced by different chemical substituents in the additive. The additive itself is preferably also a compound useful in imaging elements, but does not necessarily need to be.

Solid particle dispersions of compounds useful in imaging elements, such as photography and thermal printing elements, can be prepared more quickly, or with a finer particle size, and with improved stability to particle growth and needle growth if the compound of interest is mixed with a structurally similar compound prior to dispersal. The amount of additive used can vary over a wide range as long as it is less than that of the main compound of interest. Preferably, the additive is used in the range of 0.05% to 50%, more preferably at or above at least 0.1% and at or below at most 20%, and most preferably at or above at least 0.5% and at or below at most 10%, the percentages being by weight, based on the weight of the compound of interest.

In the case of milling dispersal methods, a coarse aqueous premix containing the solid compound useful in imaging and water, and, optionally, any desired combination of water soluble surfactants and polymers, is made, and the structurally similar additive is added to this premix prior to the milling operation. The resulting mixture is then loaded into a mill. The mill can be, for example, a ball mill, media mill, attritor mill, jet mill, vibratory mill, or the like. The mill is charged with the appropriate milling media such as, for example, beads of silica, silicon nitride, sand, zirconium oxide, yttria-stabilized zirconium oxide, alumina, titanium, glass, polystyrene, etc. The bead sizes typically range from 0.25 to 3.0 mm in diameter, but smaller media may also be used if desired. Compounds and structurally similar additives in the slurry are subjected to repeated collisions with the milling media, resulting in crystal fracture and consequent particle size reduction.

Generally for use in imaging elements, a solid particle dispersion of this invention should have an average particle size of 0.01 to about 10μm, preferably 0.05 to about 5μm, and more preferably about 0.05 to about 3μm. Most preferably, the solid particles are of a sub-micron average size. Generally, the desired particle size can be achieved by milling the slurry for 30 minutes to 31 days, preferably 60 minutes to 14 days, depending on the mill used. The amount of additive used is preferably in the range of 0.05% to 50%, and is more preferably at or above at least 0.1% and at or below at most 20%, the percentages being by weight, based on the weight of the compound of interest. It is important that the structurally similar additive be incorporated before milling in accordance with this embodiment of the invention, as we believe the repeated collisions between the main compound and the additive in the mill are necessary to achieve the desired particle size stability.

In the case of pH precipitation techniques, an aqueous solution of the compound of interest is made at relatively high pH. The structurally similar additive is simultaneously dissolved in this high pH solution prior to lowering the pH to cause precipitation. The aqueous solution can further contain appropriate surfactants and polymers previously disclosed for use in making pH precipitated dispersions. For solvent precipitation, a solution of the compound of interest is made in some water miscible, organic solvent, in which the additive is also dissolved. The solution of the compound useful in imaging and the additive is added to an aqueous solution containing appropriate surfactants or polymers to cause precipitation as previously disclosed for use in making solvent precipitated dispersions. The amount of additive used for precipitated dispersions is preferably at least about 0.5% and at most about 20% of the weight amount of main compound. It is important that the structurally similar additive be dissolved along with the compound of interest prior to precipitation in accordance with this embodiment of the invention, as we believe the compound of interest and the additive must be precipitated together to achieve the desired stability.

While not restricting our invention to any proposed mechanism, it is believed undesirable particle growth in solid particle dispersions of crystalline compounds occurs by an Oswald ripening mechanism, whereby molecules of the solid particle dipsersion compound diffuse through the aqueous phase from small particles to large particles. Compounds with even exceptionally low water-solubility have been found to be subject to such particle growth. While not wishing to be bound to any theory, we believe that additives in accordance with the invention are capable of incorporating themselves into a crystal lattice consisting of the main compound and the structurally similar additive, and that such incorporation aids in the stability of the dispersed solid particles to undesired particle growth. If the additive compound has less than about 75% of the chemical structure of the main compound, it may not effectively incorporate itself into the surface layers of the crystal lattice of the main compound.

Structurally similar additives are defined as distinct compounds derived from the chemical structure of the main or parent compound of interest, such that a section comprising at least 75% (measured on an atomic mass basis) of the main compound's chemical structure is maintained in the additive. This can be accomplished, conceptually, by breaking one or more bonds in the chemical structure of the compound of interest, and replacing the substituents on one side of the broken bond by different substituents. This new "fragmented" molecule is then reassembled at the site of the broken bond. The structure section common to both the main compound and additive must be at least 75% (measured in partial molecular mass) of the main compound.

The structurally similar additive compounds of the invention have at least one substituent bonded to the identical portion common to the main parent compound which has a molecular weight higher than the corresponding substituent of the main compound. In a preferred embodiment of this invention, the structurally similar additive is derived from the parent compound by substitution of higher molecular mass substituents at two or fewer sites in the structure of the parent compound. In a more preferred embodiment, the substitution of a higher molecular weight substituent occurs at a single site in the structure of the main compound. In the most preferred embodiment, the substitution occurs at a single site, and the added substituent has an molecular mass from 12 to 200 Daltons greater than the substituent which is replaced on the main compound. If the structurally similar additive compound has a molecular mass less than 12 Daltons greater than that of the main compound of interest, it may not have as significant an effect upon the solid particle stability as is desired even though it is freely incorporated into the lattice of the main compound. Alternatively, if an additive has a molecular mass greater than 200 Daltons more than that of a corresponding main compound of interest, the additive may not effectively incorporate itself into the surface layers of the crystal lattice of the main compound for some solid particle dispersions of compounds useful in imaging.

Valid substituents used in creating the additive of this invention consist of the set of all organic substituents, including aliphatic groups, aryl groups, ester groups, amides, alcohols, ethers, etc. Preferred substituents have molecular masses above 12 Daltons and are alkyl, aryl, or alkyl-aryl, or alkyl, aryl, or alkyl-aryl substituents containing single amide, alkyl-ester, alkyl-amide groups, or dialkyl-amide groups.

Surfactants and other additional conventional addenda may also be used in the dispersing processes described herein in accordance with prior art solid particle dispersing procedures. It is specifically contemplated, e.g., to use the surfactants, polymers, and other addenda as disclosed in U.S. Ser. No. 08/228,839 and U.S. Pat. Nos. 5,300,394, 5,278,037, 4,006,025, 4,294,916, 4,294,917, 4,940,654, 4,950,586, 4,927,744, 5,279,931, 5,158,863, 5,135,844, 5,091,296, 5,089,380, 5,013,640, 4,990,431, 4,970,139, 5,256,527, 5,015,564, 5,008,179, 4,957,857, and 2,870,012, UK 1,570,362, and GB 1,131,399 referenced above, the disclosures of which are hereby incorporated by reference, in the dispersing process of the invention.

Additional surfactants or other water soluble polymers can also be added after formation of the solid particle dispersion, before or after subsequent addition of the small particle dispersion to an aqueous coating medium. The resulting dispersion of the compound useful in imaging containing the structurally similar additive of this invention can be added to another aqueous medium, if desired, for coating, e.g., onto a photographic or thermal printing element support. The aqueous medium preferably contains other compounds such as stabilizers and dispersants, for example, additional anionic, nonionic, zwitterionic, or cationic surfactants, and water soluble binders such as gelatin as is well known in the imaging element art. This aqueous coating medium may further contain other dispersions or emulsions of compounds useful in imaging, especially photography and thermal printing imaging.

In a preferred embodiment of the invention, the compound useful in imaging dispersed in accordance with this invention is a compound useful in photography or thermal printing imaging. Such compound may be, e.g., a coupler, a filter dye (including antihalation dyes, trimmer dyes, and UV absorbing dyes), a thermal transfer dye, an oxidized developer scavenger, a sensitizing dye, an antioxidant, an anti-stain agent, an anti-fade agent, a silver halide developing agent, an antifoggant, etc. In particularly preferred embodiments of the invention, the compound useful in photography or thermal printing is an organic non-metal complex filter dye or thermal transfer dye. The invention is particularly useful in minimizing undesired particle growth of aqueous solid particle dispersions of photographic filter dyes which are relatively insoluble at pH's of less than 7 and readily soluble or decolorizable at pH's of greater than 8.

Examples of compounds useful in photographic imaging elements can be found in Research Disclosure, September 1994, Item 36544, published by Kenneth Mason Publication, Ltd., Dudley House, 12 North Street, Emsworth, Hampshire P010 7DQ, England, and the patents and other references cited therein, which are incorporated herein by reference. For solid particle dispersions of compounds useful in photographic imaging elements, such as dispersions of a coupler, oxidized developer scavenger, filter dye, UV absorbing dye or antihalation dye prepared in accordance with the invention, the resulting dispersion can be used in the preparation of a photographic element comprising a support, such as paper or film, having coated thereon at least one light sensitive layer. The dispersion can be coated in a non-imaging layer, such as an interlayer, or the dispersion may be mixed with photosensitive components, such as a silver halide emulsion, and coated in an imaging layer onto the support. In further embodiments of this invention, the solid particle dispersion may be mixed with conventional dispersions of photographically useful compounds containing organic solvents. If desired, the dispersions of the invention can be stored either separately or as a mixture with other components until needed. The preparation of single and multi-layer photographic elements is described in Research Disclosure 308119 dated December 1989, the disclosure of which is incorporated herein by reference.

Solid particle filter dye dispersions prepared in accordance with the invention may be used in coated layers of photographic elements to absorb light from different regions of the spectrum, such as red, green, blue, ultraviolet, and infrared light. The filter dyes are often required to perform the function of absorbing light during the exposure of the photographic element so as to prevent or at least inhibit light of a certain region of the spectrum from reaching at least one of the radiation sensitive layers of the element. The solid particle filter dye dispersion is typically coated in an interlayer between dye-forming layers, or in an antihalation layer directly above the support. Filter dyes of this type are usually solubilized and removed or at least decolorized during photographic processing.

In a preferred embodiment of the invention, the main compound comprises a photographic filter dye of formula I which is relatively insoluble at pH of less than 7 and readily soluble or decolorizable in photographic processing solutions at pH of 8 or above.

$$D-(X)_n \qquad (I)$$

In formula I, D represents a residue of a compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton may be, e.g., a carboxyl group, a sulfonamido group, a sulfamoyl group, a sulfonylcarbamoyl group, a carbonylsulfamoyl group, a hydroxy group, and the enol group of a oxohol dye. To form solid particle aqueous dispersions, dyes should be used which are substantially insoluble at pH below 7, such dyes being preferably less than 1% soluble by weight in solution. The function of the ionizable proton is to solubilize or decolorize the dye in processing solutions at pH of 8 or above.

Such general class of alkaline soluble, solid particle filter dyes represented by formula (I) is well known in the photographic art, and includes, e.g., dyes described in International Pat. Publication WO88/04794, European patent applications EP 594 973, EP 549 089, EP 546 163 and EP 430 180; U.S. Pat. Nos. 4,803,150, 4,855,221, 4,857,446, 4,900,652, 4,900,653, 4,940,654, 4,948,717, 4,948,718, 4,950,586, 4,988,611, 4,994,356, 5,098,820, 5,213,956, 5,260,179, and 5,266,454; the disclosures of each of which are herein incorporated by reference.

Particularly preferred filter dyes include those of formula (II):

$$[D-(A)_y]-X_n \qquad (II)$$

where D, X and n are as defined above, and A is an aromatic ring bonded directly or indirectly to D, y is 0 to 4, and X is bonded either on A or an aromatic ring portion of D.

Exemplary dyes in accordance with these preferred embodiments of the invention include those in Tables I to X of WO088/04794, formulas(I) to (VII) of EP 0 456 163 A2, formula (II) of EP 0 594 973, and Tables I to XVI of U.S. Pat. No. 4,940,654 incorporated by reference above.

For solid particle dispersions of compounds useful in thermal transfer printing imaging elements, such as dispersions of a thermal transfer dye prepared in accordance with the invention, the resulting dispersion can be used in the preparation of a thermal transfer printing element. Dispersions of thermal transfer dyes prepared in accordance with the invention may be used in coated layers of thermal transfer printing elements in donor materials, and provide a source of thermally mobile image dye that may be transferred imagewise onto an appropriate receiver material. Thermal transfer dyes which may be used in accordance with this invention include, e.g., anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.); and any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference.

Illustrative main compound/additive pairs that can be used in accordance with this invention are described below. The main compound is given the designation D-n where n is an integer, while an additive for the main compound in accordance with the invention is designated A-na where a is a letter. It is understood that this list is representative only, and not meant to be exclusive. The main compounds are known, and may be synthesized using conventional processes as disclosed in the above referenced patents and publications. The additive compounds may be synthesized using analogous techniques as used to form the main compounds, or may be formed by modifying the main compounds using conventional chemical synthesis techniques.
D-1
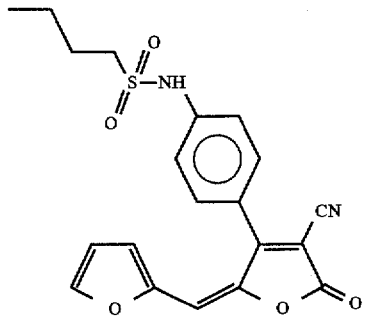
A-1a
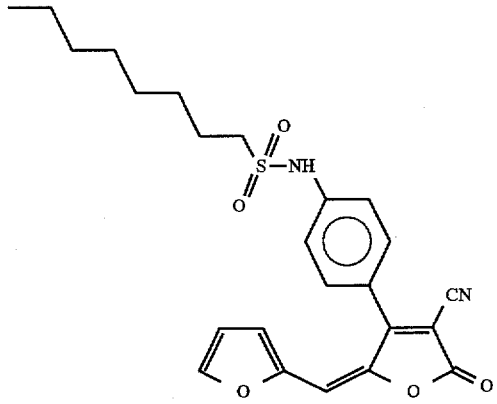
A-1b
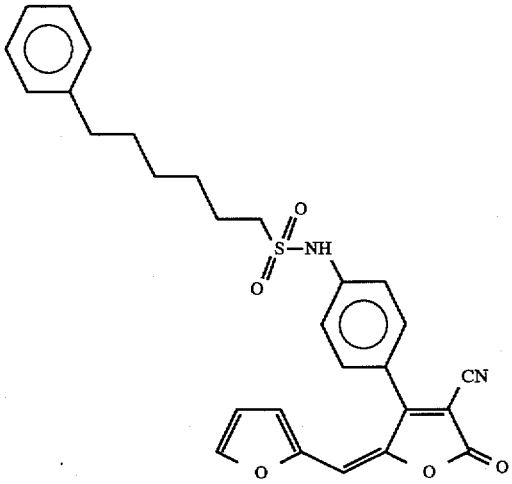
D-2
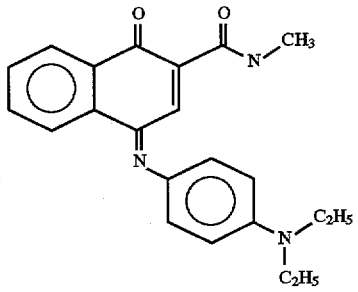
A-2a
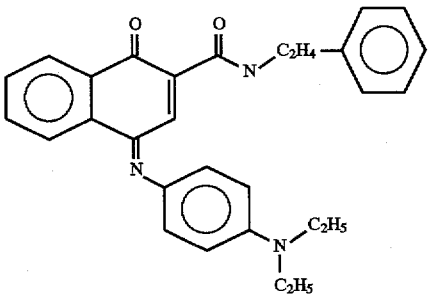
A-2b
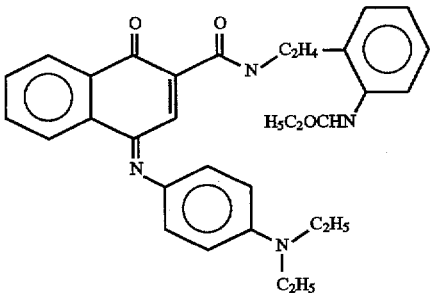
A-2c
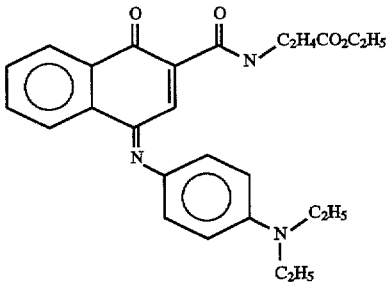
A-2d
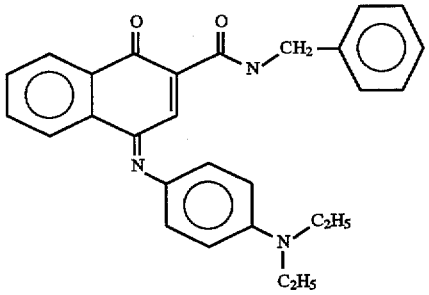

-continued
D-3
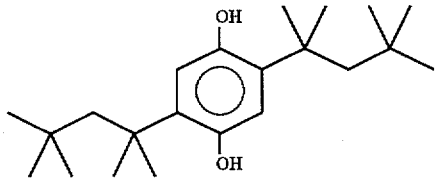
A-3a
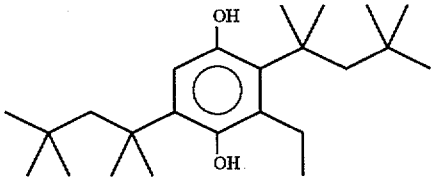
D-4
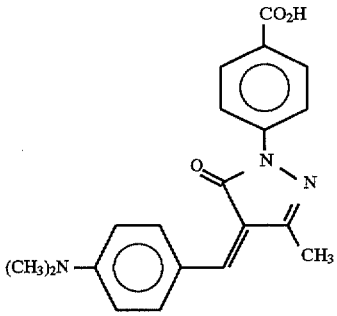
A-4a
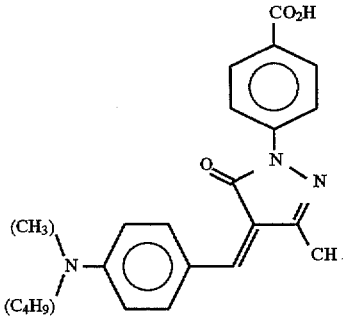
A-4b
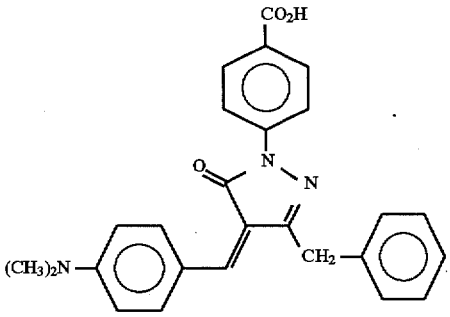
D-5
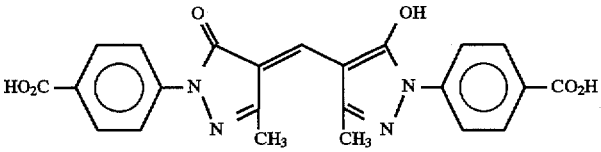
A-5a
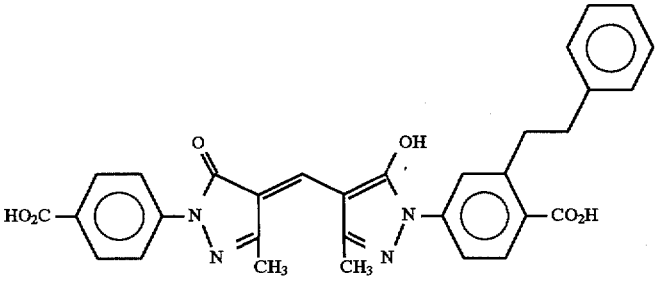
D-6
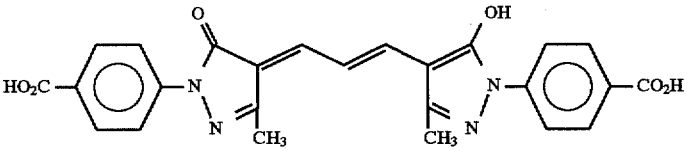
A-6a
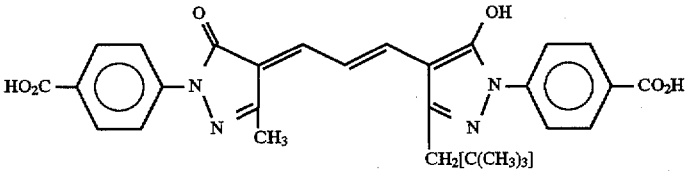

-continued

D-7

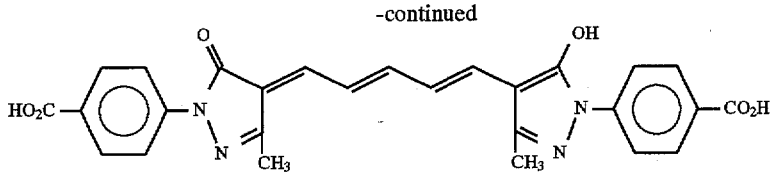

A-7a

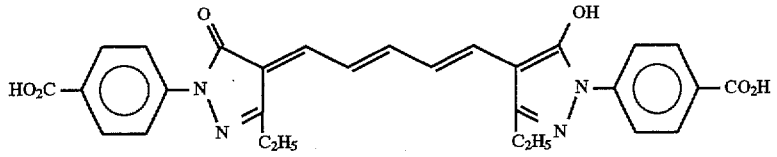

D-8

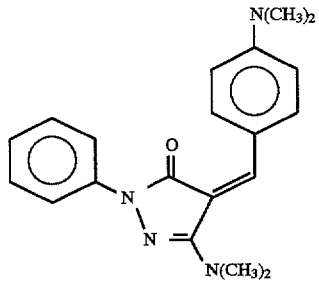

A-8a

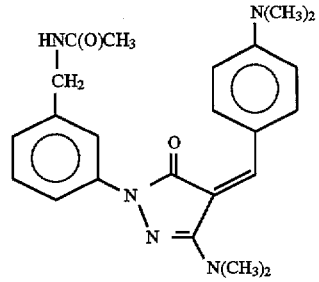

D-9

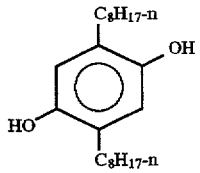

A-9a

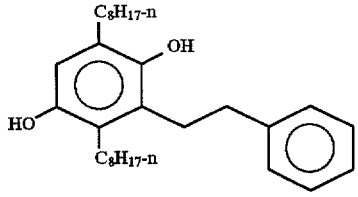

D-10

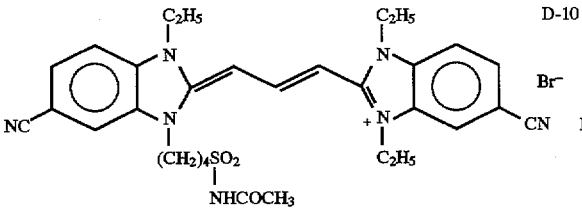

A-10a

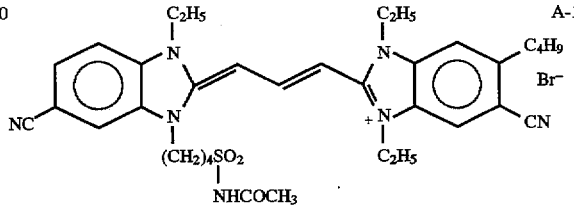

Photographic imaging elements in accordance with one embodiment of the invention may be prepared by coating a support film with one or more photosensitive layers comprising a silver halide emulsion and optionally one or more subbing, inter, overcoat or backcoat layers, at least one of such layers containing a solid particle dispersion of a main compound and an additive prepared in accordance with the invention. The coating processes can be carried out on a continuously operating machine wherein a single layer or a plurality of layers are applied to the support using conventional techniques. For multi-color elements, layers can be coated simultaneously on the composite support film as described in U.S. Pat. Nos. 2,761,791 and 3,508,947. Additional useful coating and drying procedures are described in Research Disclosure, Vol. 176, December 1978, Item 17643. Suitable photosensitive image forming layers are those which provide color or black and white images.

The photosensitive layers can be image-forming layers containing photographic silver halides such as silver chloride, silver bromide, silver bromoiodide, silver chlorobromide, and the like. Both negative working and reversal silver halide elements are contemplated. Suitable emulsions and film formats, as well as examples of other compounds and manufacturing procedures useful in forming photographic imaging elements in accordance with the invention, can be found in Research Disclosure, September 1994, Item 36544, published by Kenneth Mason Publication, Ltd., Dudley House, 12 North Street, Emsworth, Hampshire P010 7DQ, England, and the patents and other references cited therein, the disclosures of which are incorporated herein by reference. The preparation of single and multilayer photographic elements is also described in Research Disclosure 308119 dated December 1989, the disclosure of which is incorporated herein by reference. It is specifically contemplated that the film formats, materials and processes described in an article titled "Typical and Preferred Color Paper, Color Negative, and Color Reversal Photographic Elements and Processing," published in *Research Disclosure*, February 1995, Volume 370, the disclosure of which is incorporated herein by reference, may also be advantageously used with the solid particle dispersions of the invention.

The imaging elements of this invention can be coated with a magnetic recording layer as discussed in Research Disclosure 34390 of November 1992, the disclosure of which is incorporated herein by reference.

In accordance with the invention, the solid particle filter dyes can be essentially completely removed or decolorized from a photographic element upon photographic processing with an alkaline aqueous processing solution. The described elements can be, e.g., processed in conventional commercial photographic processes, such as the known C-41 color negative and RA-4 color print processes as described in *The British Journal of Photography Annual* of 1988, pages 191–199. Motion picture films may be processed with ECN or ECP processes as described in Kodak Publication No. H-24, Manual For Processing Eastman Color Films. Where applicable, the element may be processed in accordance with the Kodak Ektaprint 2 Process as described in Kodak Publication No. Z-122, using Kodak Ektaprint chemicals. To provide a positive (or reversal) image, the color development step can be preceded by development with a non-chromogenic developing agent to develop exposed silver halide, but not form dye, and followed by uniformly fogging the element to render unexposed silver halide developable. For elements that lack incorporated dye image formers, sequential reversal color development with developers containing dye image formers such as color couplers is illustrated by the Kodachrome K-14 process (see U.S. Pat. Nos. 2,252,718; 2,950,970; and 3,547,650). For elements that contain incorporated color couplers, the E-6 color reversal process is described in the *British Journal of Photography Annual* of 1977, pages 194–197.

The following examples illustrate the preparation and use of stabilized solid particle dispersions in accordance with this invention.

EXAMPLE 1

A control solid particle dispersion of a filter dye was made by placing 40.0 g of filter dye D-1 in an 32 oz glass jar containing 100 g distilled water, 60 g of a 6.67 wt% aqueous solution of Triton X-200 surfactant and 500 ml of 1.8 mm zirconium oxide beads. The jar was placed on a roller mill for 10 days. This dispersion will be referred to as S-1. A dispersion (S-2) according to the present invention was made in the same manner as above, except that 40 g of the filter dye D-1 was replaced with 36 g of D-1 and 4 g of the additive A-1a. A dispersion (S-3) according to the present invention was made in the same manner as S-1, except that 40 g of D-1 was replaced with 38.6 g of D-1 and 1.4 g of A-1a. A dispersion (S-4) according to the present invention was made in the same manner as S-1, except that 40 g of D-1 was replaced with 39.6 g of D-1 and 0.4 g of A-1a. An oxidized developer scavenger dispersion was prepared by dissolving 48.0 g of compound I in 48.0 g of di-n-butylphthalate and 96.0 g of ethyl acetate at 60° C., then combined with an aqueous phase consisting of 64.0 g gelatin, 24.0 g of a 10% solution of Alkanol XC (Dupont) and 520.0 g distilled water. The mixture was then passed through a colloid mill 5 times followed by evaporation of the ethyl acetate using a rotary evaporator. Water was added to the dispersion to yield a dispersion having 6.0% scavenger and 8.0% gelatin.

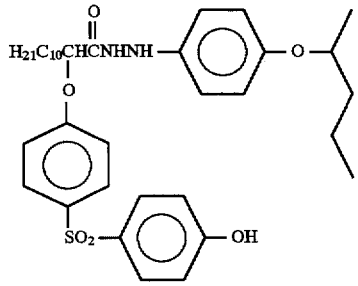

Compound I 295.28 g of this oxidized developer dispersion were combined with 17.96 g of a 6.67% solution of TX-200 and 6.76 g of water and held at 45° C. to make mixture M-A. 30 g of the filter dye dispersion S-1 (control) were combined with 24 g of gelatin and 66 g of water, and also held at 45° C. to make mixture M-1. M-1 and 80 g of M-A were mixed, held for one hour at 45° C., and then passed through a 5 micron filter. 30 g of filter dye dispersion S-2 (invention) were combined with 24 g of gelatin and 66 g of water, and held at 45° C. to make mixture M-2. M-2 and 80 g of M-A were mixed, held for one hour at 45° C., and then passed through a 5 micron filter. This procedure was repeated for dispersions S-3 and S-4. The time required to filter 80 g of the coating mixtures containing dye dispersion and oxidized developer dispersion are given in Table I:

TABLE I

| Components | Ratio of additive to dye | Time to filter 80 g | Particle size |
|---|---|---|---|
| S-1 + M-A (control) | 0 | 750 sec | 0.14 μm |
| S-2 + M-A (invention) | 0.11 | 25 | 0.14 μm |
| S-3 + M-A (invention) | 0.035 | 20 | 0.12 μm |
| S-4 + M-A (invention) | 0.01 | 15 | 0.15 μm |

Results from Table I show that coating mixtures containing dispersions made according to the present invention are much more filterable than dispersions made according to the prior art. The dye dispersions of the present invention have particle sizes approximately equal to or smaller than the control dispersion.

EXAMPLE 2

A solid particle dispersion of a thermal transfer dye, S-5 (control), was prepared by placing 1.21 g of D-2 in a 120 ml glass jar containing 21.59 g of distilled water, 1.20 g of an aqueous solution of Tetronic 908 and 60 ml of 1.8 mm zirconium oxide beads. A second dye dispersion, S-6 (invention), was made in the same manner as S-5, except it contained a mixture of 1.10 g of D-2 and 0.11 g of A-2a in place of dye D-2 alone. A third dye dispersion, S-7 (invention), was prepared in the same manner as S-5, except it contained a mixture of 1.10 g of dye D-2 and 0.11 g of A-2c in place of dye D-2 alone. After milling, the dispersions were held at 60° C. for 6 hours. After this period, the dispersions were examined for particle growth by optical microscopy at 1110= magnification. Results are given in Table II:

TABLE II

| | Microscopic results at t = 0 hrs | Microscopic results at t = 6 hrs at 60° C. |
|---|---|---|
| S-5 (control, D-2) | all particles less than 1 μm | many particles 10–40 μm |
| S-6 (invention, D-2 + A-2a) | all particles less than 1 μm | all particles less than 1 μm |
| S-7 (invention, D-2 + A-2c) | all particles less than 1 μm | all particles less than 1 μm |

Results from this table show that stable solid particle dispersions of a thermal transfer dye can be obtained using structurally similar additives, but the control dispersion with no additive was unstable to particle growth.

The invention has been described in detail with particular reference to preferred embodiments thereof, but it is to be understood that variations and modifications can be effected within the spirit and scope of the invention.

We claim:

1. A process for preparing a solid particle aqueous dispersion of a first compound useful in imaging elements, where dispersed solid particles of said first compound are subject to undesirable particle growth in aqueous mediums when said first compound is dispersed in the absence of any other distinct compound structurally similar to said first compound, and said first compound is other than a phthalocyanine pigment said process comprising: (a) adding a structurally similar distinct additive to said first compound, such additive and first compound each comprising an identical structural section thereof which makes up at least 75% of the total molecular weight of the first compound, and the additive having at least one substituent bonded to the identical structural section which has a molecular weight higher than the corresponding substituent if the first compound, and (b) dispersing said first compound and additive together in an aqueous medium.

2. The process of claim 1, wherein said first compound and additive are dispersed by milling an aqueous slurry of said compound and additive.

3. The process of claim 1, wherein said first compound and additive are dispersed by precipitating said compound and additive from solution.

4. The process according to claim 1, wherein the structurally similar additive compound has a total molecular mass of at least 12 Daltons greater than that of the first compound.

5. The process according to claim 1, in which only one or two substituents on said first compound are replaced with higher molecular weight substituents.

6. The process according to claim 5, in which the additive comprises a structure derived from the structure of said first compound by replacement with a higher molecular weight substituent at a single site.

7. The process according to claim 6, in which the additive substituent has a molecular mass of from 12 to 200 Daltons greater than the replaced compound substituent.

8. The process according to claim 5, in which the additive substituent is alkyl, aryl, or alkyl-aryl, or an alkyl, aryl, or alkyl-aryl substituent containing a single amide, alkyl-ester, alkyl-amide, or dialkyl-amide group.

9. The process of claim 1 wherein said first compound is a compound useful in photographic or thermal transfer printing imaging elements.

10. The process of claim 9, wherein said first compound is selected from the group consisting of couplers, sensitizing dyes, filter dyes, thermal transfer dyes, antioxidants, oxidized developer scavengers, anti-stain agents, anti-fade agents, silver halide developing agents, and antifoggants.

11. The process of claim 9, wherein said first compound is a filter dye or a thermal transfer dye.

12. The process of claim 9, wherein said first compound is an organic non-metal complex filter dye.

13. A process for preparing a solid particle aqueous dispersion of a first compound useful in imaging elements, where dispersed solid particles of said first compound are subject to undesirable particle growth in aqueous mediums when said first compound is dispersed in the absence of any other distinct compound structurally similar to said first compound, comprising:

(a) adding a structurally similar distinct additive to said first compound, such additive and first compound each comprising an identical structural section thereof which makes up at least 75% of the total molecular weight of the first compound. and the additive having at least one substituent bonded to the identical structural section which has a molecular weight higher than the corresponding substituent of the first compound, and (b) dispersing said first compound and additive together in an aqueous medium, wherein said first compound is a photographic filter dye which is substantially aqueous insoluble at pH of less than 7 and readily soluble or decolorizable in photographic processing solutions at pH of 8 or above.

14. The process of claim 13, wherein the filter dye is of formula I:

$$D-(X)_n \qquad (I)$$

where D represents a residue of a compound having a chromophoric group, X represents a group having an ionizable proton bonded to D either directly or through a bivalent bonding group, and n is 1–7.

15. The process of claim 14, wherein the residue of a compound having a chromophoric group is an oxonol dye, merocyanine dye, cyanine dye, arylidene dye, azomethine dye, triphenylmethane dye, azo dye, or anthraquinone dye, and the group having an ionizable proton is a carboxyl group, a sulfonamido group, a sulfamoyl group, a sulfonylcarbamoyl group, a carbonylsulfamoyl group, a hydroxy group, or an enol group of a oxonol dye.

16. The process of claim 9, wherein said first compound is a thermal transfer dye.

17. The process of claim 1, wherein the structurally similar distinct additive and first compound each comprise an identical structural section thereof which makes up at least 90% of the total molecular weight of the first compound.

18. The process of claim 1, wherein the structurally similar distinct additive and first compound each comprise an identical structural section thereof which makes up at least 99% of the total molecular weight of the first compound.

19. The process of claim 1, wherein the additive is present in the dispersion at from 0.05 to 50 wt % of the first compound.

20. The process of claim 19, wherein the additive is present in the dispersion at 20 wt % of the first compound or less.

21. The process of claim 1, wherein the additive is present in the dispersion at 0.5 wt % of the first compound or greater.

22. A stable solid particle dispersion comprising solid particles of a first compound useful in imaging elements and from 0.05 to 50 wt %, based on the weight of the first compound, of a structurally similar distinct additive dispersed together in an aqueous medium, such additive and first compound each comprising an identical structural section thereof which makes up at least 75% of the total molecular weight of the first compound, and the additive having at least one substituent bonded to the identical structural section which has a molecular weight higher than the corresponding substituent of the first compound, where dispersed solid particles of said first compound are subject to undesirable particle growth in aqueous mediums when said first compound is dispersed in the absence of any other distinct compound structurally similar to said first compound, and said first compound is other than a phthalocyanine pigment.

23. A dispersion of claim 22, wherein the solid particle dispersion has an average particle size of less than one micron.

24. A dispersion of claim 22, wherein the first compound is a compound useful in photographic or thermal transfer printing imaging elements selected from the group consisting of couplers, sensitizing dyes, filter dyes, thermal transfer dyes, antioxidants, oxidized developer scavengers, anti-stain agents, anti-fade agents, silver halide developing agents, and antifoggants.

25. A dispersion of claim 24, wherein the first compound is an organic non-metal complex filter dye.

26. A stable solid particle dispersion comprising solid particles of a first compound useful in imaging elements and from 0.05 to 50 wt %, based on the weight of the first compound, of a structurally similar distinct additive dispersed together in an aqueous medium, such additive and first compound each comprising an identical structural section thereof which makes up at least 75% of the total molecular weight of the first compound, and the additive having at least one substituent bonded to the identical structural section which has a molecular weight higher than the corresponding substituent of the first compound, where dispersed solid particles of said first compound are subject to undesirable particle growth in aqueous mediums when said first compound is dispersed in the absence of any other distinct compound structurally similar to said first compound, wherein the first compound is a photographic filter dye which is substantially aqueous insoluble at pH of less than 7 and readily soluble or decolorizable in photographic processing solutions at pH of 8 or above.

27. A dispersion of claim 26, wherein the filter dye is of formula I:

$$D-(X)_n \quad (I)$$

where D represents a residue of a compound having a chromophoric group, X represents a group having an ionizable proton bonded to D either directly or through a bivalent bonding group, and n is 1–7.

28. A dispersion of claim 27, wherein the residue of a compound having a chromophoric group is an oxonol dye, merocyanine dye, cyanine dye, arylidene dye, azomethine dye, triphenylmethane dye, azo dye, or anthraquinone dye, and the group having an ionizable proton is a carboxyl group, a sulfonamido group, a sulfamoyl group, a sulfonylcarbamoyl group, a carbonylsulfamoyl group, a hydroxy group, or an enol group of a oxonol dye.

29. A dispersion of claim 24, wherein the first compound is a thermal transfer dye.

30. A photographic element comprising a support bearing at least one silver halide emulsion layer, and at least one layer, which may be the same as or different from the silver halide emulsion layer, which comprises a stable solid particle dispersion comprising solid particles of a first compound useful in imaging elements and from 0.05 to 50 wt %, based on the weight of the first compound, of a structurally similar distinct additive dispersed together in an aqueous medium, such additive and first compound each comprising an identical structural section thereof which makes up at least 75% of the total molecular weight of the first compound. and the additive having at least one substituent bonded to the identical structural section which has a molecular weight higher than the corresponding substituent of the first compound, where dispersed solid particles of said first compound are subject to undesirable particle growth in aqueous mediums when said first compound is dispersed in the absence of any other distinct compound structurally similar to said first compound.

* * * * *